US006821097B2

(12) United States Patent
Reinert

(10) Patent No.: US 6,821,097 B2
(45) Date of Patent: Nov. 23, 2004

(54) CONCRETE PUMP WITH S-TUBE VALVE ASSEMBLY WITH WEAR RING-SPRING-RETAINER RING CONSTRUCTION

(75) Inventor: Gerald H. Reinert, Cold Spring, KY (US)

(73) Assignee: Reinert Manufacturing Co., Florence, KY (US)

( * ) Notice: Subject to any disclaimer, the term of this patent is extended or adjusted under 35 U.S.C. 154(b) by 0 days.

(21) Appl. No.: 10/269,215

(22) Filed: Oct. 11, 2002

(65) Prior Publication Data

US 2004/0071575 A1 Apr. 15, 2004

(51) Int. Cl.[7] ..... F04B 15/02

(52) U.S. Cl. ..... 417/517; 417/518; 417/532; 417/900

(58) Field of Search ..... 417/234, 454, 417/455, 507, 510, 516, 517, 518, 519, 532, 900; 91/189 A, 191, 193, 291, 293, 294, 400, 520; 137/612, 595

(56) References Cited

U.S. PATENT DOCUMENTS

| | | | | |
|---|---|---|---|---|
| 3,612,730 A | | 10/1971 | Reinert | |
| 3,897,180 A | | 7/1975 | Reinert | |
| 4,241,641 A | | 12/1980 | Reinert | |
| 4,653,990 A | * | 3/1987 | Schlecht | 417/517 |
| RE32,719 E | * | 7/1988 | Schwing | 417/517 |
| 5,302,094 A | * | 4/1994 | Schlecht et al. | 417/517 |
| 6,305,916 B1 | | 10/2001 | Reinert | |
| 6,443,718 B1 | * | 9/2002 | Vincent | 417/518 |

FOREIGN PATENT DOCUMENTS

| | | | |
|---|---|---|---|
| DE | 000052192 A1 | * | 5/1982 |
| JP | 35700679 A | * | 12/1982 |

* cited by examiner

*Primary Examiner*—Michael Koczo

(57) ABSTRACT

A concrete pump includes a hopper having a plate with a pair of openings and an S-tube valve assembly which is movable between the two openings. The valve assembly includes an S-tube which is connected to a mounting plate which is pivotally mounted on the hopper. A wear ring is movably supported within an opening in the valve assembly and engages the hopper plate. A retainer ring is positioned within the opening of the valve assembly and engages a flange on the valve assembly. A resilient spring is positioned between the wear ring and the retainer ring and resiliently urges the wear ring against the hopper plate.

13 Claims, 6 Drawing Sheets

CONCRETE PUMP WITH S-TUBE VALVE ASSEMBLY WITH WEAR RING-SPRING-RETAINER RING CONSTRUCTION

BACKGROUND

This invention relates to concrete pumps, and, more particularly, to a concrete pump with a hopper and a pivotable S-tube valve assembly.

Concrete pumps are well known in the construction industry and are used for pumping concrete or other pumpable construction materials. Concrete pumps are described, for example, in U.S. Pat. Nos. 3,612,730, 3,897,180, 4,241,641, and 6,305,916.

Most concrete pumps which are currently being manufactured include two concrete pumping cylinders and an S-shaped tube valve for alternately connecting the outlet end of each pumping cylinder to the discharge conduit of the concrete pump. The S-tube valve is pivotably mounted in a concrete hopper. As the piston in one of the pumping cylinders moves toward the hopper to pump concrete through the S-tube valve to the discharge conduit, the piston in the other pumping cylinder retracts away from the hopper to draw concrete into the cylinder.

A typical S-tube valve assembly is described in U.S. Pat. No. 6,305,916. The valve assembly includes an S-tube and a mounting plate for the S-tube which is pivotally mounted on the hopper. A wear ring is mounted in an opening in the valve assembly and engages a wear plate on the hopper.

U.S. Reissue Pat. No. 32,657 describes an S-tube valve with a flexible and resilient spring which is positioned in recesses in the S-tube and in the wear ring for forcing the wear ring against the wear plate. However, a portion of the S-tube which retains the spring is exposed to the abrasive action of the concrete which is pumped through the wear ring and the S-tube. That portion of the S-tube is therefore subject to wear, and when that portion is worn sufficiently so that the spring is no longer properly supported, the S-tube must be replaced.

SUMMARY OF THE INVENTION

A removable retainer ring is positioned between the spring and the S-tube valve assembly. The retainer ring abuts a face on the valve assembly and protects the face from abrasion. When the retainer ring wears out, the retainer ring can be replaced without replacing the valve assembly.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
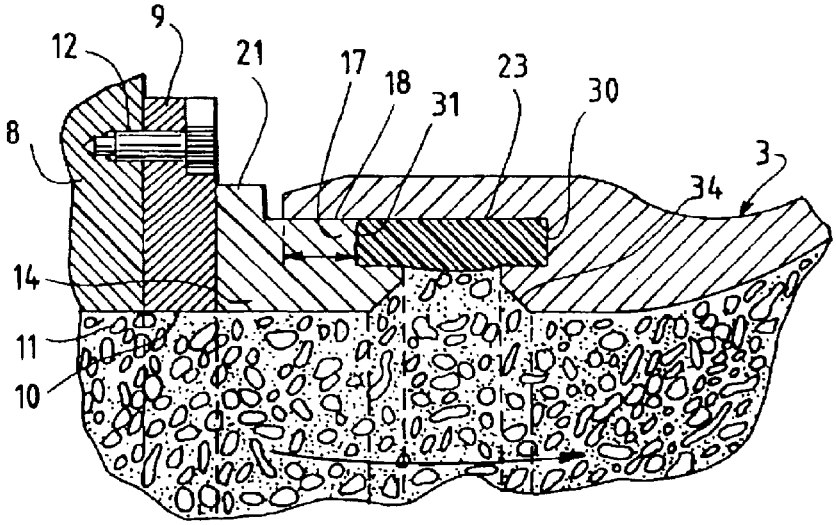
FIG. 1 PRIOR ART
FIG. 1 illustrates the prior art wear ring and S-tube valve assembly of U.S. Reissue Pat. No. 32,657.
Figure 2:
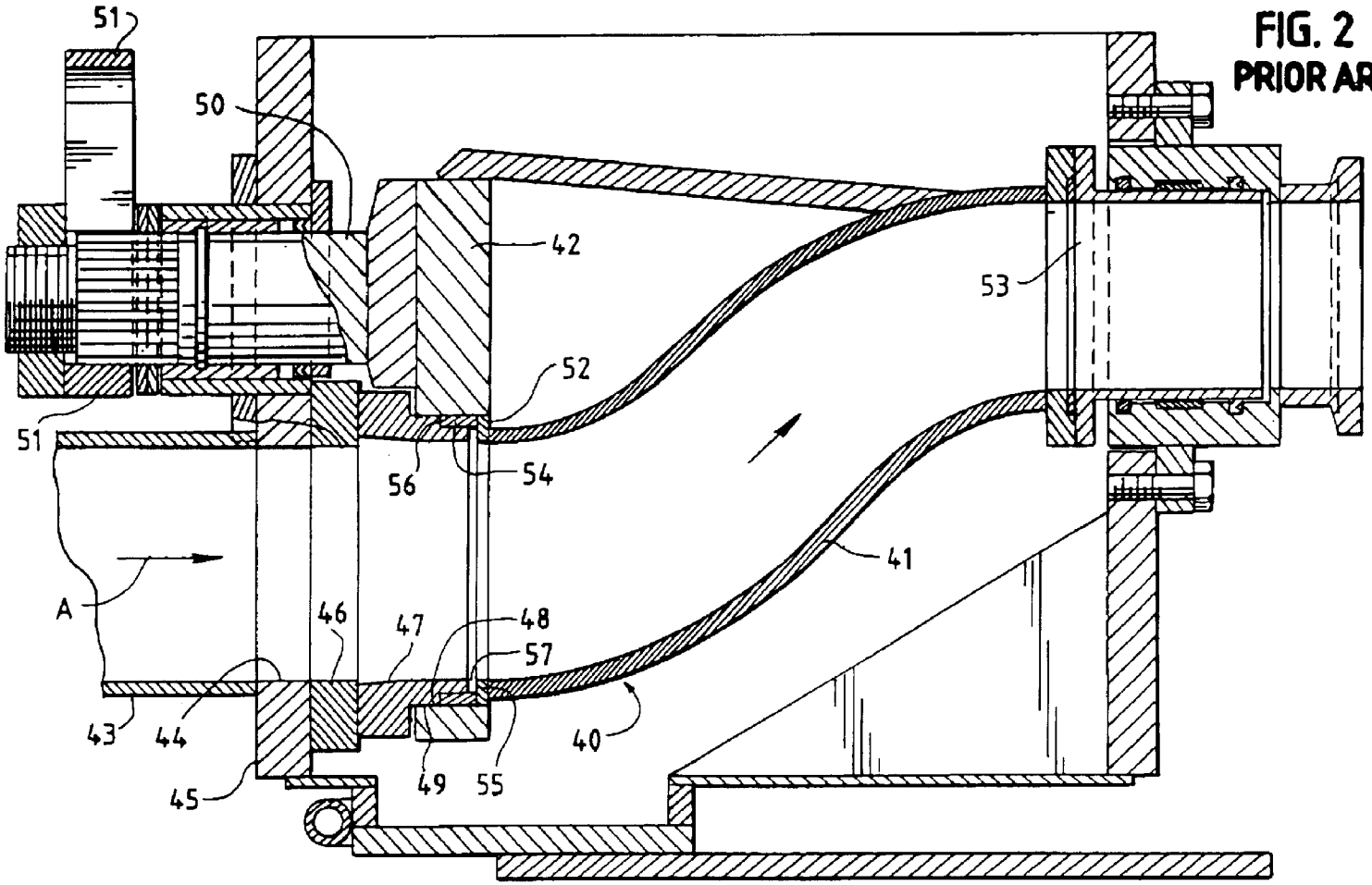
FIG. 2 PRIOR ART
FIG. 2 is a fragmentary sectional view of another prior art wear ring and S-tube valve assembly.

FIG. 1 is FIG. 2 of U.S. Reissue Pat. No. 32,657. As described in the patent, a concrete pump includes a hopper 8 which is provided with a pair of openings 11. A wear plate 9 is attached to the hopper by screws 12, and the wear plate is provided with openings 10 which are aligned with the openings 11. An S-shaped tube valve 3 is pivotally mounted on the hopper by a mounting plate (not shown) for movement between the two openings 10 in the wear plate. A wear ring 14 includes a cylindrical surface 18 which is mounted for axial sliding movement inside of a cylindrical surface 17 on the S-tube. A flexible rubber annular spring 23 is positioned in recesses in the wear ring and in the S-tube and engages radial faces 30 and 31. The spring forces the wear ring against the wear plate 9 to provide a seal between the wear ring and the wear plate.

As illustrated by the arrow in FIG. 1, the pumping cylinder which is aligned with the openings 10 and 11 forces concrete to flow axially through the openings in the wear ring and the S-tube. The portion of the S-tube which is radially inward of the spring 23 (see reference numeral 34 in FIG. 1) is exposed to the flowing concrete and is subjected to being worn by the highly abrasive material. When that portion of the S-tube is worn sufficiently so that it can no longer properly support the spring, the S-tube must be replaced.

FIG. 2 illustrates another prior art wear ring and S-tube valve assembly 40. The valve assembly includes an S-tube 41 and a mounting plate 42. A pumping cylinder 43 communicates with an opening 44 in a hopper 45. A wear plate 46 is mounted on the inside of the hopper. A wear ring 47 includes a cylindrical surface 48 which is mounted for axial sliding movement within a cylindrical surface 49 in the lower end of the mounting plate 42. The upper end of the mounting plate is connected to a trunnion 50 which is rotatably mounted on the hopper. The trunnion is rotated by a crank arm 51 to pivot the mounting plate, S-tube, and wear ring between the two openings in the wear plate. The S-tube 41 is connected to an annular flange 52 on the mounting plate which extends radially inwardly beyond the cylindrical surface 49. The other end of the S-tube is connected to a tube 53 which is rotatably mounted in an opening in the wall of the hopper.

A resilient spring 54 is positioned between an inside face 55 on the annular flange 52 and an annular face 56 on the wear ring. The spring urges the wear ring against the wear plate.

Additional details of concrete pumps, hoppers, and S-tube valve assemblies are described in U.S. Pat. No. 6,305,916.

The inside face 55 on the annular flange 52 is exposed to the concrete which is pumped in the direction of arrow A through the wear ring and the S-tube valve assembly. The face 55 will eventually be worn so that it no longer provides proper support for the spring 54. The S-tube valve assembly will then have to be replaced.

The portion of the spring 54 which is exposed between the wear ring 47 and the flange 52 is subjected to deterioration from the hydrostatic pressure of the concrete and from grout and other materials in the concrete. The spring may eventually lose its elasticity and can sometimes protrude from the space between the wear ring and the flange.

Grout can also flow through the gap 57 between the wear ring and the mounting plate, between the cylindrical surfaces 48 and 49 of the wear ring and the mounting plate, and into the space between the face 56 and the spring 54. The grout thereby interferes with the ability of the spring to force the wear ring against the wear plate 46.

Figure 3:
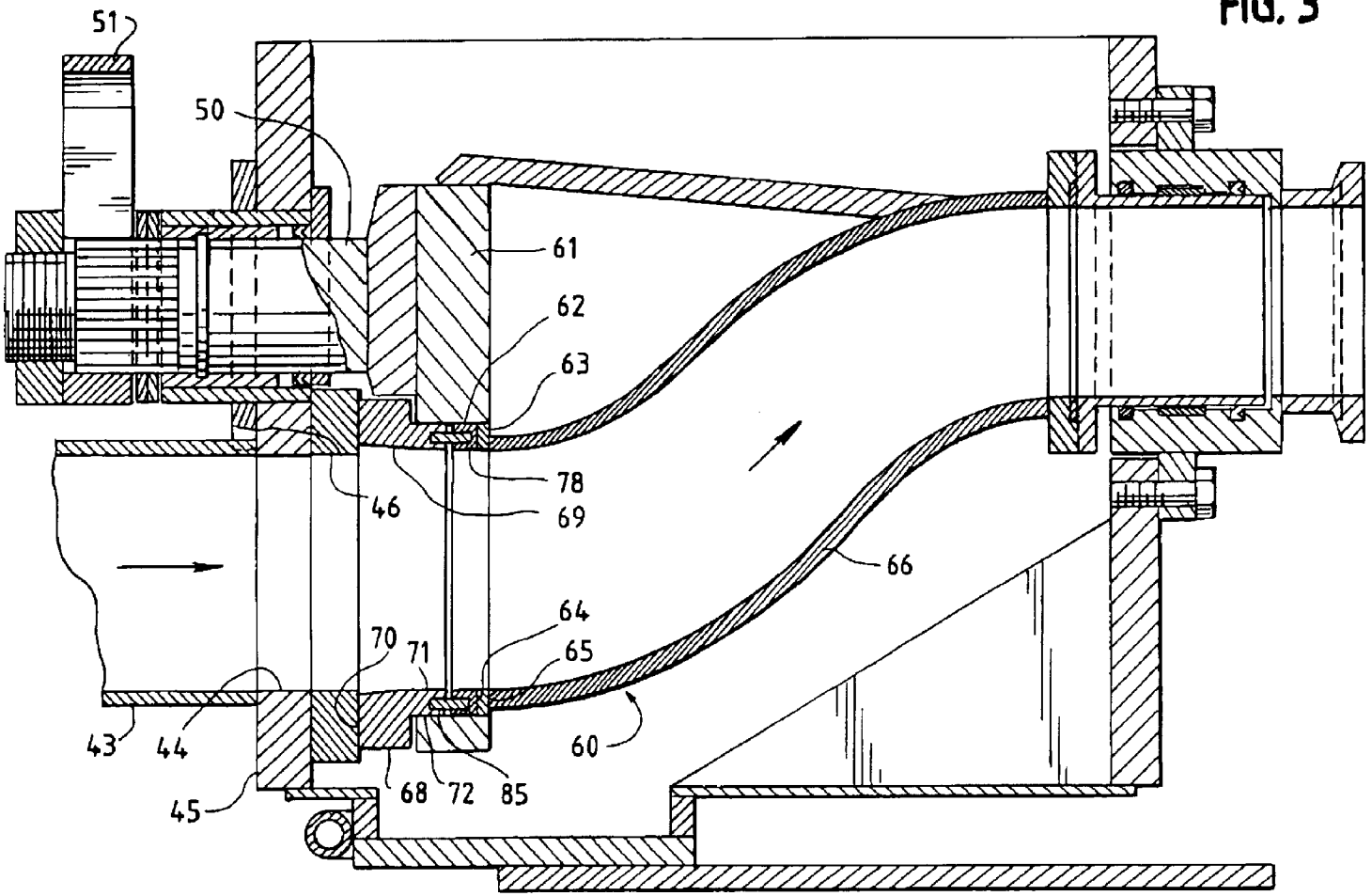
FIG. 3 is a fragmentary sectional view similar to FIG. 2 of a wear tube and an S-tube valve assembly which is formed in accordance with the invention.

FIG. 3 illustrates a modified wear ring and S-tube valve assembly 60 which is formed in accordance with the invention. As in FIG. 2, a pumping cylinder 43 of a concrete pump communicates with an opening 44 in a hopper 45. A wear plate 46 is mounted on the inside of the hopper. A mounting plate 61 is connected to the trunnion 50. The mounting plate includes a cylindrical surface 62 and an annular flange 63 which extends radially inwardly from the cylindrical surface. The flange includes inside and outside faces 64 and 65. An S-tube 66 is attached to the outside face 65.

Figure 6:
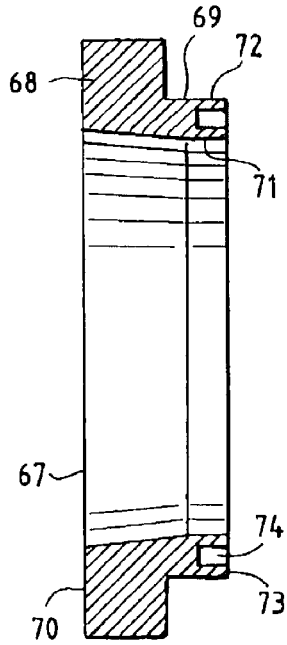
FIG. 6 is a sectional view of the wear ring of FIG. 5.

A wear ring 67 includes an annular body 68 and a cylindrical extension 69. The body 68 includes a face 70 which engages the wear plate 46 on the hopper 45. The cylindrical extension 69 includes inside and outside cylindrical surfaces 71 and 72 and an inside end 73 (see also FIG. 6). An annular groove or recess 74 extends into the end 73 between the cylindrical surfaces 71 and 72. The cylindrical surface 72 of the wear ring is axially slidable within the cylindrical surface 62 of the mounting plate 61.

Figure 8:
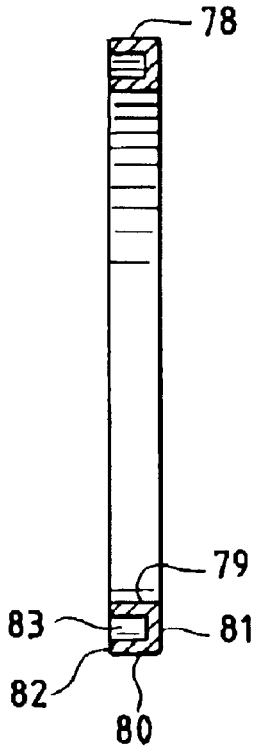
FIG. 8 is a sectional view of the retainer ring of FIG. 5.
Figure 9:
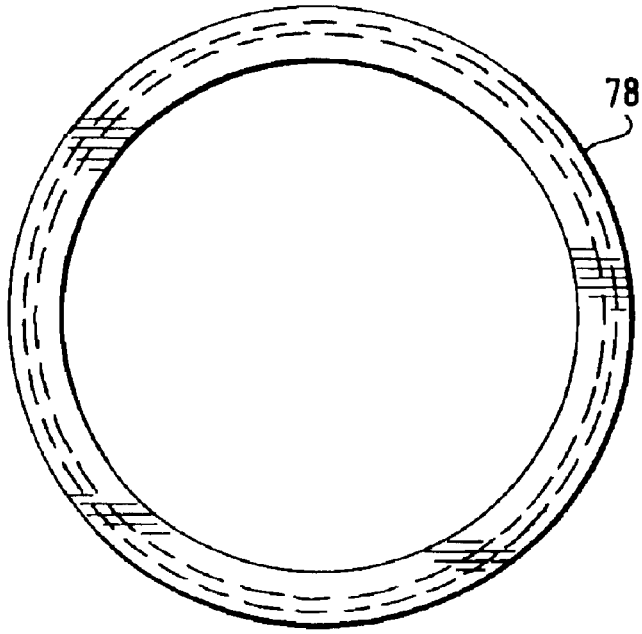
FIG. 9 is an end view of the retainer ring of FIG. 8.

An annular retainer ring 78 includes inside and outside cylindrical surfaces 79 and 80 and end faces 81 and 82 (see also FIGS. 8 and 9). An annular groove or recess 83 extends into the end 82 between the cylindrical surfaces 79 and 80. The cylindrical surface 80 is axially slidable within the cylindrical surface 62 of the mounting plate 61.

A flexible and resilient cylindrical spring 85 extends into the grooves 74 and 83 of the wear ring 67 and the retainer ring 78. The spring forces the retainer ring against the flange 63 of the mounting plate and forces the wear ring against the wear plate 46. The face 64 of the flange 63 provides an abutment or shoulder for the retainer ring.

The inside diameter of the retainer ring 78 is preferably substantially the same, or less than, the inside diameter of the flange 63 of the mounting plate, and the retainer ring abuts and completely covers or substantially covers the inside face 64 of the flange. The face 64 is thereby protected from the abrasive effects of the concrete which is pumped through the valve assembly.

The end face 82 of the retainer ring is exposed to the concrete and is subject to wear. However, when the retainer ring is worn out, it can be replaced quickly and inexpensively without replacing the mounting plate and the S-tube.

In one specific embodiment the spring 85 was a neoprene strap which had a one inch axial dimension and inside and outside diameters of 5.250 and 5.750 inches. The thickness of the spring was therefore 0.250 inch. The width of the grooves 74 and 83 in the wear ring and retainer ring in the radial direction was 0.25 inch.

Figure 5:
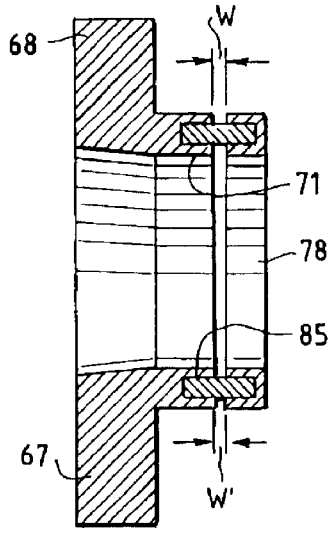
FIG. 5 is a sectional view of the wear ring, retainer ring, and spring of FIG. 3.
Figure 7:
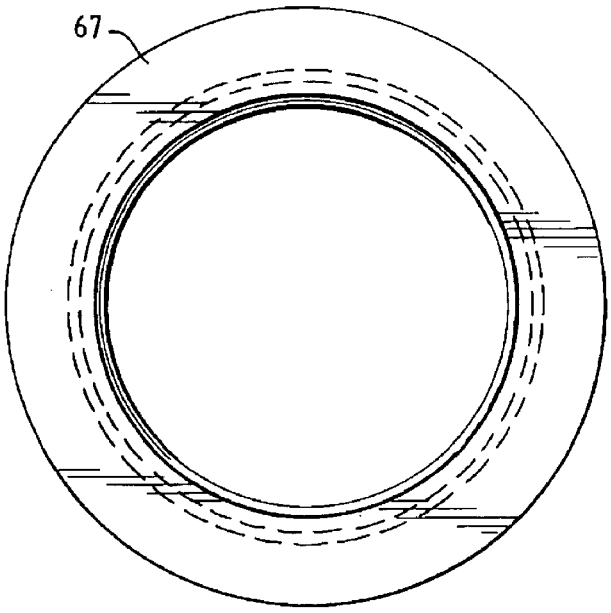
FIG. 7 is an end view of the wear ring of FIG. 6.

Referring to the upper portion of FIG. 5, the width w of the gap between the wear ring and the retainer ring when the spring was relaxed was 0.187 inch. Referring to the bottom portion of FIG. 5, the width +e,fra w'+ee of the gap when the spring was compressed by the flange 63 and the wear plate 46 was 0.125 inch. The small gap when the wear ring and retainer ring are confined between the flange and the wear plate minimizes the exposure of the spring to the concrete which is pumped through the valve and reduces wear and deterioration of the spring.

The spring can also be formed from nylon reinforced belting, urethane or rubber having a Shore A durometer of about 40 to 50, or other suitable materials.

In the embodiment illustrated in FIG. 3, the retainer ring 78 is axially slidable within a cylindrical surface 62 of the mounting plate and abuts a radial face 64 on the flange 63 of the mounting plate. However, the retainer ring and spring can also be mounted within a cylindrical recess in the S-tube as illustrated in Reissue Pat. No. 32,657. Referring to FIG. 1, the axially extending lip on the S-tube which extends below the spring 23 (see reference numeral 34) could be eliminated, and the right end of the spring could be inserted into a retainer ring which abutted the radial face 30 of the S-tube.

Figure 10:
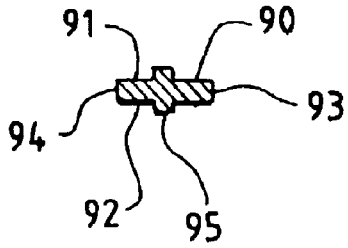
FIG. 10 is a sectional view of a modified spring.

FIG. 10 illustrates a modified embodiment of a resilient spring 90 which has a cruciform cross-section. The spring 90 includes inside and outside cylindrical surfaces 91 and 92, ends 93 and 94, and a midportion 95 which extends radially inwardly and outwardly from the cylindrical surfaces. The midportion 95 is positioned in the gap between the retainer ring and the wear ring and provides some protection against abrasion of the retainer ring.

Figure 4:
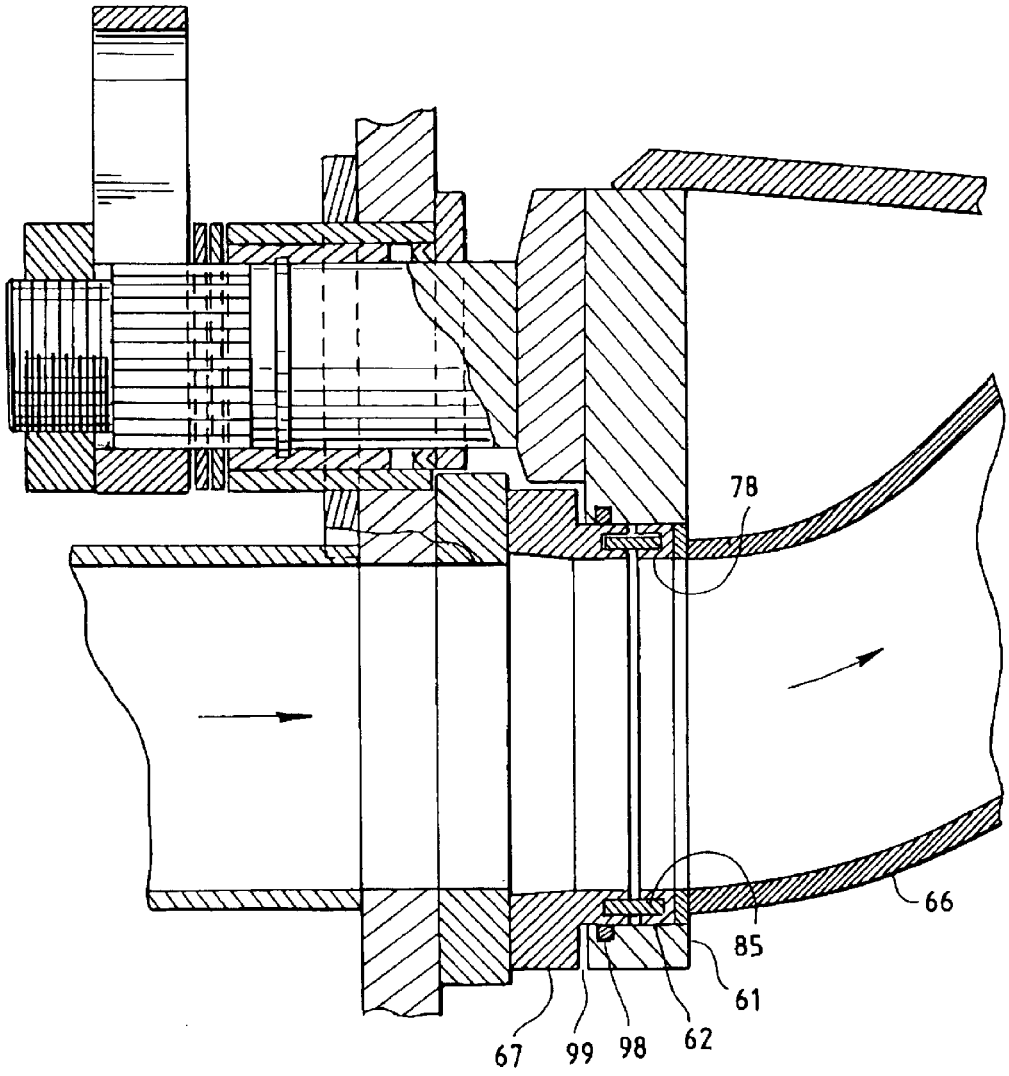
FIG. 4 is a view similar to FIG. 3 of a modified embodiment of the invention.

FIG. 4 illustrates a modified valve assembly which includes a compressible and resilient O-ring 98 which is mounted in a radially inwardly extending groove in the cylindrical surface 62 of the mounting plate 61. The O-ring 98 provides a seal between the mounting plate and the wear ring and prevents or retards flow of grout from the gap 99 between the wear ring and the mounting plate to the spring 85.

The O-ring could also be mounted in a groove in the cylindrical surface of the wear ring which slides on the cylindrical surface 62. Also, a sealing gasket other than an O-ring could be used for sealingly engaging the wear ring and the cylindrical surface of the mounting plate.

While in the foregoing specification a detailed description of specific embodiments of the invention was set forth for the purpose of illustration, it will be understood that many of the details hereingiven may be varied considerably by those skilled in the art without departing from the spirit and scope of the invention.

I claim:

1. In a concrete pump, a hopper having an opening therein, a valve assembly pivotally mounted on the hopper, the valve assembly including an S-tube and a mounting plate connected to the S-tube, the valve assembly having a opening therethrough for allowing concrete to flow through the valve assembly and a shoulder in the opening, a wear ring movably supported within the opening of the valve assembly, a retainer ring slidably and removably mounted within the opening of the valve assembly and engaging said shoulder, and a resilient spring compressed between the retainer ring and the wear ring for resiliently urging the wear ring toward the opening in the hopper.

2. The structure of claim 1 in which the retainer ring substantially covers the shoulder of the valve assembly whereby the shoulder is protected from concrete flowing through the valve assembly.

3. The structure of claim 1 in which the valve assembly includes a cylindrical surface which forms part of the opening in the valve assembly and the shoulder extends radially inwardly from the cylindrical surface.

4. The structure of claim 3 in which the inside diameter of the retainer ring is substantially the same as the inside diameter of the shoulder whereby the shoulder is protected from concrete flowing through the valve assembly.

5. The structure of claim 3 including means for providing a seal between the wear ring and said cylindrical surface.

6. The structure of claim 1 in which the opening of the valve assembly includes an opening in the mounting plate, the retainer ring and the wear ring being mounted within the opening in the mounting plate.

7. In a concrete pump, a hopper having an opening therein, a valve assembly pivotally mounted on the hopper, the valve assembly including an S-tube and a mounting plate connected to the S-tube, the valve assembly having an opening therethrough for allowing concrete to flow through the valve assembly and a shoulder in the opening, the valve assembly including a cylindrical surface which forms part of the opening in the valve assembly the shoulder extending radially inwardly from the cylindrical surface, a wear ring movably supported within the opening of the valve assembly, a retainer ring mounted within the opening of the valve assembly and engaging said shoulder, the outside diameter of the retainer ring being slightly less than the diameter of said cylindrical surface of the valve assembly whereby the retainer ring is axially slidable inside of the cylindrical surface and a resilient spring compressed between the retainer ring and the wear ring for resiliently urging the wear ring toward the opening in the hopper.

8. In a concrete pump, a hopper having an opening therein, a valve assembly pivotally mounted on the hopper, the valve assembly including an S-tube and a mounting plate connected to the S-tube, the valve assembly having an opening therethrough for allowing concrete to flow through the valve assembly and a shoulder in the opening, the valve assembly including a cylindrical surface which forms part of the opening in the valve assembly, the shoulder extending radially inwardly from the cylindrical surface, a wear ring movably supported within the opening of the valve assembly, means for providing a seal between the wear ring and said cylindrical surface, said sealing means being an O-ring, a retainer ring mounted within the opening of the valve assembly and engaging said shoulder, and a resilient spring compressed between the retainer ring and the wear ring for resiliently urging the wear ring toward the opening in the hopper.

9. The structure of claim 8 in which said O-ring is mounted in a groove in said cylindrical surface.

10. In a concrete pump, a hopper having an opening therein, a valve assembly pivotally mounted on the hopper, the valve assembly including an S-tube and a mounting plate connected to the S-tube, the valve assembly having an opening therethrough for allowing concrete to flow through the valve assembly and a shoulder in the opening, the valve assembly including a cylindrical surface which forms part of the opening in the valve assembly, the shoulder extending radially inwardly from the cylindrical surface, a wear ring movably supported within the opening of the valve assembly, a retainer ring mounted within the opening of the valve assembly and engaging said shoulder, and a resilient spring compressed between the retainer ring and the wear ring for resiliently urging the wear ring toward the opening in the hopper, the spring including a pair of ends and the retainer ring is being provided with an annular groove which receives one of the ends of the spring.

11. The structure of claim 10 in which the wear ring is provided with an annular groove which receives the other end of the spring.

12. In a concrete pump, a hopper having an opening therein, a valve assembly pivotally mounted on the hopper, the valve assembly including an S-tube and a mounting plate connected to the S-tube, the valve assembly having an opening therethrough for allowing concrete to flow through the valve assembly and a shoulder in the opening, a wear ring movably supported within the opening of the valve assembly, a retainer ring mounted within the opening of the valve assembly and engaging said shoulder, and a resilient spring compressed between the retainer ring and the wear ring for resiliently urging the wear ring toward the opening in the hopper, the opening of the valve assembly including an opening in the mounting plate, the retainer ring and the wear ring being mounted within the opening in the mounting plate, said shoulder being on the mounting plate.

13. In a concrete pump, a hopper having an opening therein.

a valve assembly pivotally mounted on the hopper, the valve assembly including an S-tube and a mounting plate connected to the S-tube, the valve assembly having an opening therethrough for allowing concrete to flow through the valve assembly and a shoulder in the opening, a wear ring movably supported within the opening of the valve assembly, a retainer ring mounted within the opening of the valve assembly and engaging said shoulder, and a resilient spring compressed between the retainer ring and the wear ring for resiliently urging the wear ring toward the opening in the hopper, the opening spring compressed between the valve assembly including an opening in the mounting plate, the retainer ring and the wear ring being mounted within the opening in the mounting plate, the mounting plate including a cylindrical surface which forms part of the opening in the mounting plate and said shoulder being on the mounting plate and extending radially inwardly from the cylindrical surface.

* * * * *

UNITED STATES PATENT AND TRADEMARK OFFICE

CERTIFICATE OF CORRECTION

PATENT NO. : 6,821,097 B2
DATED : November 23, 2004
INVENTOR(S) : Reinert

It is certified that error appears in the above-identified patent and that said Letters Patent is hereby corrected as shown below:

Column 6,
Line 52, delete “spring compressed between” and insert -- of --.

Signed and Sealed this

Nineteenth Day of July, 2005

JON W. DUDAS
*Director of the United States Patent and Trademark Office*